US007513712B2

(12) United States Patent
Hanstvedt

(10) Patent No.: US 7,513,712 B2
(45) Date of Patent: Apr. 7, 2009

(54) DEVICE AND A METHOD FOR DRAINAGE OF WATER FROM ROCK CAVES

(75) Inventor: Alv Hanstvedt, Dimmelsvik (NO)

(73) Assignee: Giertsen Tunnel AS, Bergen (NO)

( * ) Notice: Subject to any disclaimer, the term of this patent is extended or adjusted under 35 U.S.C. 154(b) by 380 days.

(21) Appl. No.: 10/967,069

(22) Filed: Oct. 15, 2004

(65) Prior Publication Data

US 2005/0097845 A1 May 12, 2005

(30) Foreign Application Priority Data

Oct. 15, 2003 (NO) ..... 20034607

(51) Int. Cl.
*E02B 5/00* (2006.01)

(52) U.S. Cl. ..... 405/118; 405/119; 404/2; 404/4; 52/14; 52/16

(58) Field of Classification Search ..... 52/302.1, 52/11, 13, 14–16, 127.5, 462, 478; 405/118, 405/119; 404/2, 4
See application file for complete search history.

(56) References Cited

U.S. PATENT DOCUMENTS

| | | | | | |
|---|---|---|---|---|---|
| 739,559 | A * | 9/1903 | Rinker | 52/13 |
| 1,322,189 | A * | 11/1919 | Holt | 52/13 |
| 4,129,967 | A * | 12/1978 | Barlow | 52/15 |
| 4,663,894 | A * | 5/1987 | LaRoche et al. | 52/15 |
| 5,014,745 | A * | 5/1991 | Watt | 137/615 |
| 5,066,165 | A * | 11/1991 | Wofford et al. | 405/119 |
| 5,184,435 | A * | 2/1993 | Sherman | 52/12 |
| 5,213,438 | A * | 5/1993 | Barenwald | 404/2 |
| 5,335,460 | A * | 8/1994 | Smith, Jr. | 52/11 |
| 5,357,719 | A * | 10/1994 | Lewis | 52/11 |
| 5,438,803 | A * | 8/1995 | Blizard, Jr. | 52/12 |
| 5,765,328 | A * | 6/1998 | Moore | 52/302.1 |
| 5,882,145 | A * | 3/1999 | Beamer | 405/118 |
| 6,185,889 | B1 * | 2/2001 | Gilgan et al. | 52/302.1 |

(Continued)

FOREIGN PATENT DOCUMENTS

DE 874317 4/1953

(Continued)

*Primary Examiner*—Richard E Chilcot, Jr.
*Assistant Examiner*—Chi Q Nguyen
(74) *Attorney, Agent, or Firm*—Banner & Witcoff, Ltd.

(57) ABSTRACT

A device of a water draining system for caverns is described, comprising one or more sections of tunnel covering or tunnel canvas which is arranged in the cavern at a certain distance from the walls and ceiling of the cavern, and a draining pipe system for leading away water. The device is characterized by one solid extended ceiling draining pipe, where the one longitudinal lower edge side of a first tunnel covering is arranged to the one internal side edge of the concave part of the ceiling draining pipe, while the one longitudinal lower side edge of a second tunnel covering is arranged to the other internal side edge of the concave part of the ceiling draining pipe, that the other longitudinal side edges respectively of the tunnel coverings are arranged to the ceiling or wall section of the cavern so that the canvas surfaces form a suitably inclined plane down towards the draining pipe, and that the ceiling draining pipe is secured to the ceiling section of the cavern via a number of rock bolts which are connected to and secure the ceiling draining pipe.

15 Claims, 2 Drawing Sheets

U.S. PATENT DOCUMENTS

| | | | | |
|---|---|---|---|---|
| 6,226,956 | B1 * | 5/2001 | Davis et al. | 52/745.06 |
| 6,240,679 | B1 * | 6/2001 | Smalara | 52/16 |
| 6,308,479 | B1 | 10/2001 | Prohofsky | |
| 6,380,852 | B1 | 4/2002 | Hartman et al. | |

FOREIGN PATENT DOCUMENTS

| | | |
|---|---|---|
| DE | 926255 | 4/1955 |
| DE | 4241862 | 6/1994 |
| NO | 320293 | 4/2005 |
| SE | 457549 | 11/1986 |
| WO | WO 0139222 | 5/2001 |

* cited by examiner

DEVICE AND A METHOD FOR DRAINAGE OF WATER FROM ROCK CAVES

RELATED APPLICATION

This application claims priority to Norwegian patent application 2003 4607, filed Oct. 15, 2003, which is incorporated herein by reference in its entirety.

FIELD OF THE INVENTION

The present invention relates to a device and a method for drainage of water from rock caves, tunnels and caverns. The invention also relates to an application of the device and the method in a system for draining or conducting water from rock caves, tunnels and caverns.

BACKGROUND OF THE INVENTION

During blasting of caverns, one will as a general rule break the groundwater-leading channels and crevices in the rock so that more or less permanent water leakages occur into the cavern. Consequently there is a need to lead this water away, and this has been previously been solved in different ways. Thus, different funnel and duct constructions with associated pipes that lead the water to a drainage ditch or to a similar drainage system at the floor of the cavern have been used. For example, reference is made to Norwegian patent application 1999 2485 belonging to the present applicant that shows different ditch solutions. It is also common to build in constructions of wood, steel or concrete, encompassing a covering of walls and ceiling with different types of ceiling boards and wall covering boards. Examples of this are shown in the German patents 874.317 and 926.255. It is also common to fasten such ceiling boards and wall boards onto the exposed sections of the walls and ceiling only, where there is a danger for ingress of water. Spray concrete is also used to a large extent to cover such areas. Furthermore, it is common to use different types of vault constructions to seal off the vault ceiling, and to use concrete directly against the rock, possibly with a sealing membrane.

It is also previously known to put up a watertight canvas vault corresponding to the profile of the cavern, so that a space is formed between the canvas and the rock, and where the canvas, along its two lower edge sections (along the ditch sections), runs over into the ground material such as gravel, sand and the like to form a seal. The space between the canvas and the rock wall constitutes the wet room, while the workspace underneath the canvas vault, inside the canvas surface, is the dry room.

One of the abovementioned canvas solutions, which in reality is only used sporadically these days, involves the lower edge sections, or flaps of the canvas pieces, being arranged with a U-shaped course which forms a canal that is formed in the floor of the cavern along the lower edge of the walls. The hollow space of the U-shape can be filled with gravel, while underneath (and partially beside) the U-shape, there can be coarser gravel. A concrete covering, an asphalt covering or similar floor covering, can be arranged close up to the hollow space of the U-shape.

Reference is also given to what is known from Swedish patent 457.549 and U.S. Pat. No. 6,308,479.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description below.

To overcome limitations in the prior art described above, and to overcome other limitations that will be apparent upon reading and understanding the present specification, the present invention is concerned with be ability to retain and divert water from the ceiling sections of the rock outside the canvas material and for a system which leads the water away.

A first aspect of the invention provides a new solution to handle the water that drips or runs on the upper side of the ceiling covering.

A second aspect of the invention provides a device that provides a wall and ceiling covering which is arranged in the cavern at a certain distance from the walls and ceiling of the cavern, such as via rock bolts, where an edge section of the covering is joined with the floor covering, so that a space between the covering and walls and ceiling of the cavern are isolated from a workspace that is called the dry room.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

Figure 1:
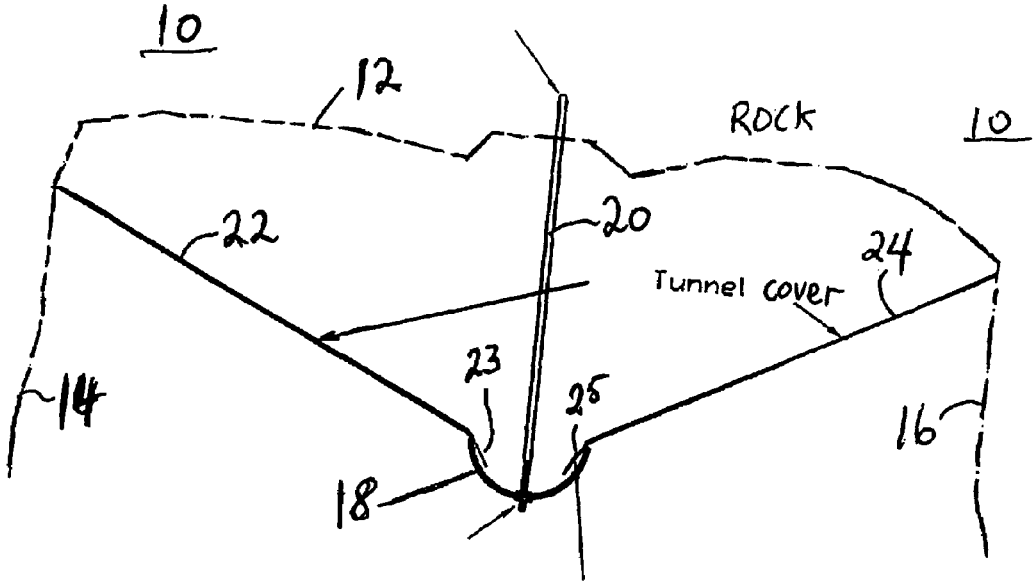
FIG. 1 shows a cross-section of a ceiling draining pipe construction according to the invention, and which is mounted in a cavern.

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

For the present invention, a draining pipe, preferably made from plastic, is used to lead the water away.

According to the invention, the draining pipe is fastened to the ceiling of the cavern with the help of a number of rock/stone bolts, which are arranged in a row with mutual distance, secured to the overhanging rock ceiling. The draining pipe is arranged with a given inclined gradient so that the water runs down in one or more down pipes and can be further led away in a known way. From each of the longitudinal sides of the draining pipe the roof covering is arranged longitudinally down into the concave part of the draining pipe and secured, for example, mechanically by gluing/welding with hot air or the like. The size of the draining pipe can vary according to the amount of water. Its location, on the one side or in the middle, can also vary. It is also possible to arrange several draining pipes in connection with the same ceiling construction.

When one knows the shape of the ceiling in the cavern, the ceiling covering can be adjusted in advance in the workshop. A draining pipe with adjusted length is formed and the necessary holes in the bottom of the draining pipe are drilled out, adjusted to the bolts that are already secured in the ceiling of the cavern where the construction is to be fitted. At the same time, the necessary holes having a larger diameter for placing and fitting of the down pipes holes are drilled. Then the two canvas sections from each longitudinal side are fastened to the inside of the draining pipe as explained above, whereupon the canvas is rolled up. The whole of the construction is brought to the cavern/hall where it is lifted up to the ceiling so that the bolt ends are led through the respective holes. The necessary set of gaskets, washers and nuts are fastened to the rock bolts so that the bolt penetrations are watertight and the draining pipe is stabilised for the exact course and slope. Then, the necessary down pipes are fitted to the adapted holes in the bottom of the draining pipe. When the draining pipe is stabilised, the canvas is rolled out and secured to the ceiling of the rock in a suitable way so that the surface of the canvas forms an inclined gradient for collection and leading of the dripping water down to the draining pipe.

Compared to the features of the abovementioned Swedish patent 457.549, the present solution is more flexible and easy to rearrange after the mounting process. The Swedish patent discloses that several U-shaped beams (4) are arranged on both sides of and in parallel to the sides of a beam (2). The structure of the present invention needs no anchoring to both sides, but can be adjusted sideways and vertically to adapt to the shape of the rock cave. Furthermore in contrast to a solid plate structure as of the Swedish proposal, the anchoring of the canvas of the present structure neither needs to be in parallel to the draining pipe. The present solution is therefore much more flexible in that it simply can be adapted to any wall and ceiling shapes of rock caves or tunnels.

The abovementioned U.S. Pat. No. 6,308,479 only discloses structures to prevent water inlet below terraces etc. and not for applications in rock caves or tunnels. Further, the beams (10) are mounted to the framing work or the like with a mutual distance of d3. Such fixings means are not present or possible in rock caves or tunnels. The structure of the present invention is not dependent on such requirements in U.S. Pat. No. 6,308,479, but can be adjusted vertically and sideways, adapting the structure for the actual place of the water flowing to be solved.

Neither of the Swedish patent 457.549 or U.S. Pat. No. 6,308,479 present any solution how to conduct the water downwardly from a guiding pipe. The present invention provides a structure that permits one to, when appropriate, connect the drain pipe at any position to the guiding pipe. The present invention presents an extremely flexible solution.

Reference shall now be made to the subsequent figures in which:

FIG. 1 shows a cross-section of a ceiling draining pipe construction according to the invention, and which is mounted in a cavern.

Figure 2:
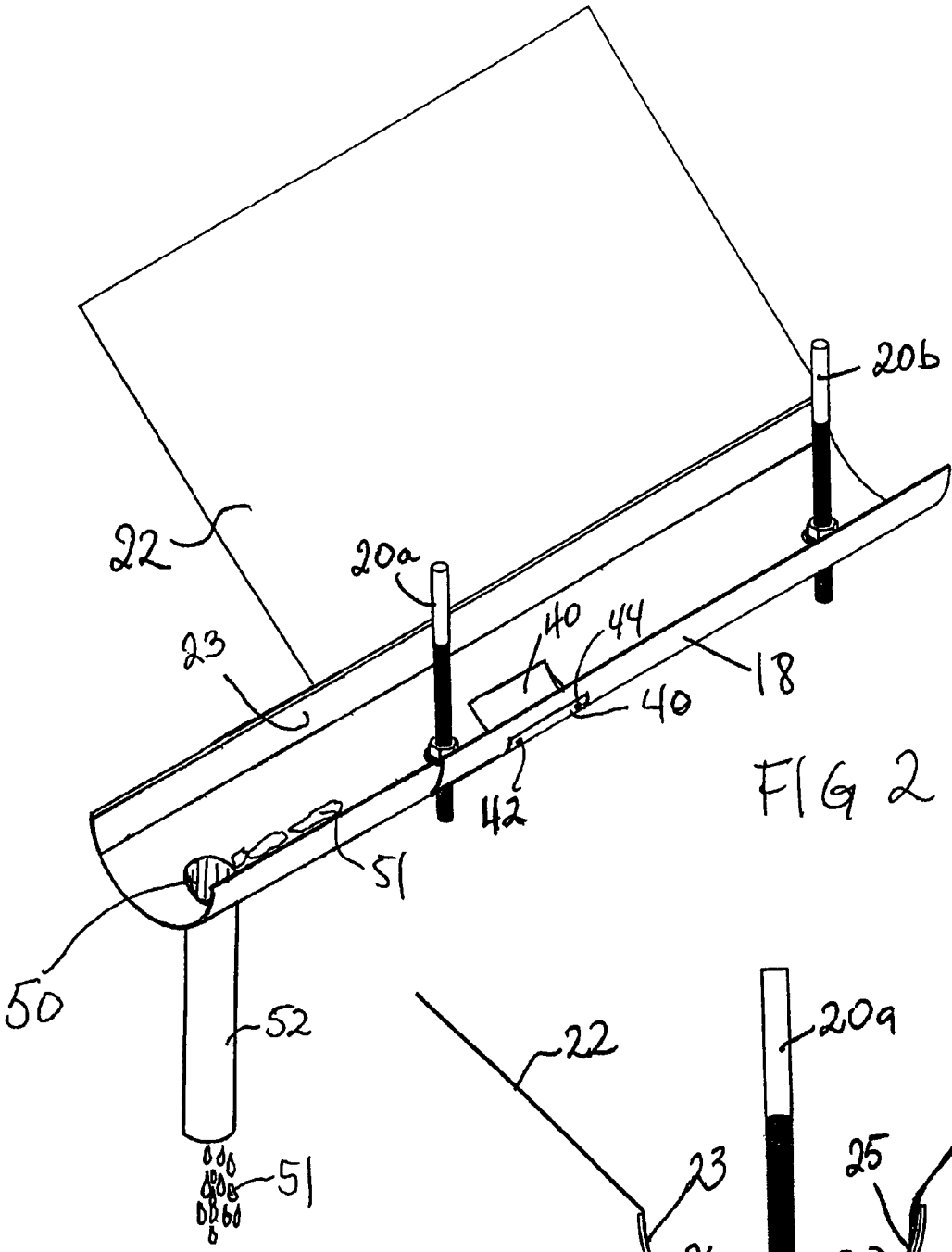
FIG. 2 shows in perspective how the ceiling draining pipe is secured in the bolt system, and how the canvas is placed in the draining pipe and taken sidelong up to the ceiling or wall section of the cavern.

FIG. 2 shows in perspective how the ceiling draining pipe is secured in the bolt system, and how the canvas is placed in the draining pipe and taken sidelong up to the ceiling or wall section of the cavern.

Figure 3:
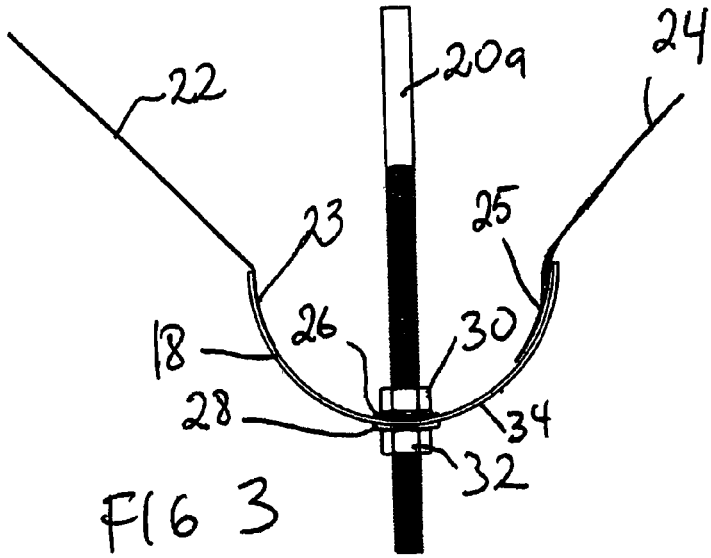
FIG. 3 shows a cross-section of the same.

FIG. 3 shows a cross-section of the same.

Reference shall initially be made to FIG. 1 that shows a cross-section of a water drainage system. A cavern 10 with ceiling 12 and walls 14,16 is shown schematically. A water draining pipe 18, hereafter called ceiling draining pipe, made of plastic or metal, is secured to the ceiling 12 with the help of a number of rock bolts 20 that are secured by being drilled into the ceiling. The water is led downwards to the draining pipe via a canvas (a tunnel canvas) 22 which is stretched from down in the pipe and sidelong up to the rock wall/ceiling 14,12 to which it has been fixed. A second corresponding canvas 24 is stretched from the other side of the draining pipe and up to the other rock wall/ceiling 16,12 and similarly fixed to the rock wall. The lower end of each of the bolts 20 comprises a threaded section for screwing on one or two nuts 30,32. A number of such rock bolts (see FIG. 2) are arranged with mutual distance in a row along the ceiling to secure the ceiling draining pipe 18. The ceiling draining pipe 18 is led up towards the ceiling so that each bolt 20 passes through appropriate holes in the bottom of the draining pipe. Each sealing draining pipe is secured to the row of bolts at a correct slope with the help of the nuts (see FIGS. 2 and 3). The sealing against water leaks through the holes in the draining pipe bottom is provided with the help of upper and lower gasket washer discs 26,28.

The draining pipe is arranged with a given slope so that the water 51 may flow down through an opening 50 in the bottom of the draining pipe 18 and into one (or more) down pipes 52, and can then be conducted away in a known manner. From both of the longitudinal sides of the draining pipe, the ceiling covering canvas is longitudinally arranged down into the concave part of the draining pipe and fastened, for example, mechanically by gluing/welding with hot air or the like. The size of the draining pipe can vary according to the amount of water. Its positioning, to the one side or in the middle, can also vary. It is also possible to arrange several draining pipes in connection with the same ceiling construction.

FIGS. 2 and 3 show a side section and a cross-section, respectively, of such a ceiling draining pipe 18 with the mentioned one canvas 22, two rock bolts 20*a*,20*b*, a gasket set comprising an upper ring gasket 26 and a lower ring gasket 28 and also an upper nut 30 and a lower nut 32.

During the fitting, the upper nut 30 is first screwed onto the threaded bolt 20*a* and the upper gasket is led onto the rod below the nut 30. This is carried out in a similar fashion along the whole of the row of bolts 20*a*, 20*b*. Then the ceiling draining pipe is brought up so that the ends of the bolts go through the holes in the bottom of the ceiling draining pipe until this forces the gasket ring 26 upwards against the underside of the nut 30. The lower gasket ring 28 is then inserted on the rod, the nut 32 is screwed onto the bolt until it forces the gasket 28 up against the underside of the draining pipe and such that the upper gasket presses up against the upper nut and against the bottom of the draining pipe. It will be evident that the slope and accurate positioning of the draining pipe is given by adjusting the row of nuts 20*a*, 20*b*.

Pre-Manufacture of Ceiling Draining Pipe with Inlaid Canvas for Ceiling Construction Knowing the shape of the ceiling in the cavern, the ceiling covering or the canvas can be adapted in advance in the workshop. A draining pipe 18 with adjusted length is prepared and the necessary holes are drilled in the bottom of the draining pipe adapted to the bolts 20*a*, 20*b* that are already secured, or shall be secured, to the ceiling 12 of the cavern where the construction shall be mounted. At the same time, the necessary holes are drilled in the bottom section of the draining pipe, and which have a larger diameter for the placing and fitting of the down pipes that are not shown in the figures. The two canvas sections 22,24 are then fastened to the inside of the draining pipe from both the longitudinal sides, as explained above, whereupon the canvas sections 22,24 are rolled up and can partially be placed in the draining pipe during storage and transportation. The whole construction is brought to the cavern/hall where it is lifted up to the ceiling so that the bolt ends are led through the respective holes. The necessary set of gaskets, washers and nuts are fastened to the rock bolts so that the bolt penetrations are watertight and the draining pipe is adjusted to an accurate course and slope. Then the necessary down pipes are fitted to the adapted holes in the draining pipe bottom.

When the draining pipe is then stabilised, the canvas is rolled out and brought up to the rock ceiling 12, or the transition between ceiling and wall, and secured in a suitable manner, so that the upper surface forms a downward gradient for collection and drainage of dripping water down to the draining pipe.

Inspection of the Tunnel Canvas and Water Draining Pipe

After the tunnel covering has been mounted, there will be a need to inspect the otherwise hidden rear side of the canvas and water draining pipe at regular intervals. Because, with the water that drips and runs down onto the canvas and into the draining pipe, particles, dust and the like often follow and these can accumulate and form a layer in the draining pipe and canvas surface and over time block the draining pipe and down pipes. Therefore, there is a need to inspect the canvas and the draining pipe to be able to carry out the necessary maintenance and cleaning. Therefore, the draining pipe comprises preferably one or more inspection hatches that can be opened to carry out the mentioned inspection. Inspection can also be carried out with the aid of a camera taking pictures (for example, a remote controlled camera via a cable) that is led in through the opening which the inspection hatch forms, and that can be moved according to need in the space at the back of the draining pipe.

Such an inspection hatch is shown in FIG. 2 with reference number 40. An opening in the draining pipe is covered by a plate-formed hatch 40, with the same shape and curvature as the draining pipe and is secured with the help of screws and the like shown by 42,44. Sealing strips placed between the outer side of the draining pipe and the inner side of the plate provide the necessary seal against water leaks.

With the present invention a new and simplified construction for drainage of water from caverns is provided. It will be evident that the fitting is very simple and the mounting operations have thereby become efficient and cost saving.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

I claim:

1. A device comprising:

a first covering and a second covering adapted to each be located at a certain distance from at least one wall and/or a ceiling of a cave, tunnel or cavern, each of the first and second coverings comprising a longitudinal lower edge side and a longitudinal upper edge side;

a rigid extended ceiling draining pipe comprising a concave part having a first internal side edge and a second internal side edge, wherein the longitudinal lower edge side of the first covering is fastened to the first internal side edge of the concave part of the ceiling draining pipe, and the longitudinal lower edge side of the second covering is fastened to the second internal side edge of the concave part of the ceiling draining pipe, and the upper longitudinal side edges of the first and second coverings are configured to be fastened to the ceiling or the at least one wall of the cave, tunnel or cavern so that the first and second coverings each provide an inclined surface down to the ceiling draining pipe;

a down pipe connected to the ceiling draining pipe; and at least one rock bolt secured to the concave part of the ceiling draining pipe, wherein the ceiling draining pipe is configured to be secured to the ceiling or the wall of the cave, tunnel or cavern via the at least one rock bolt that is connected to the ceiling draining pipe and to the ceiling or the wall of the cave, tunnel or cavern.

2. The device according to claim 1, wherein the first and second coverings are fastened to the concave part of the ceiling draining pipe mechanically by gluing/welding.

3. The device according to claim 1, wherein the at least one rock bolt is secured to the concave part of the ceiling draining pipe by its end section running through a hole in a bottom of the draining pipe and is secured with a set of upper and lower nuts and upper and lower gasket-washer discs.

4. The device according to claim 3, wherein the bottom of the draining pipe is blocked in and sealed between the upper and lower gasket-washer discs with the help of the upper and lower nuts.

5. The device according to claim 1, wherein the ceiling draining pipe defines at least one opening, the at least one opening sealed with a removable plate.

6. A water drainage system for a rock cave, tunnel or cavern, comprising the device according to claim 1.

7. A method comprising the steps of adjusting the device according to claim 1 by adjusting at least the first covering, the second covering, or a length of the ceiling draining pipe of the device to correspond to a shape of a ceiling and/or at least one wall of a rock cave, tunnel or cavern, and installing the device in the rock cave, tunnel or cavern.

8. A method comprising the steps of installing the device according to claim 1 in a rock cave, tunnel or cavern, and adjusting at least the first covering, the second covering, or a length of the ceiling draining pipe of the device to correspond to a shape of a ceiling and/or at least one wall of the rock cave, tunnel or cavern.

9. A method comprising:

providing a first covering adapted to be located at a first location with respect to at least one wall and/or a ceiling of a cave, tunnel or cavern, the first covering comprising a longitudinal lower edge side and a longitudinal upper edge side;

providing a second covering adapted to be located at a second location with respect to the at least one wall and/or the ceiling of the cave, tunnel or cavern, the second covering comprising a longitudinal lower edge side and a longitudinal upper edge side;

providing a rigid extended ceiling draining pipe comprising a concave part having a first internal side edge and a second internal side edge, wherein the longitudinal lower edge side of the first covering is fastened to the first internal side edge of the concave part of the ceiling draining pipe, and the longitudinal lower edge side of the second covering is fastened to the second internal side edge of the concave part of the ceiling draining pipe, and the upper longitudinal side edges of the first and second coverings are configured to be fastened to the ceiling or the at least one wall of the cave, tunnel or cavern so that the first and second coverings each provide an inclined surface down to the ceiling draining pipe;

connecting a down pipe to the ceiling draining pipe for leading away water; and securing at least one rock bolt to the concave part of the ceiling draining pipe, wherein the ceiling draining pipe is configured to be secured to the ceiling or the wall of the cave, tunnel or cavern via the at least one rock bolt that is connected to the ceiling draining pipe and to the ceiling or the wall of the cave, tunnel or cavern.

10. The method according to claim 9, wherein the first and second coverings are fastened to the concave part of the ceiling draining.

11. The method according to claim 9, wherein the at least one rock bolt is secured to the concave part of the ceiling draining pipe by its end section running through a hole in a bottom of the draining pipe and is secured with a set of upper and lower nuts and upper and lower gasket-washer discs.

12. The method according to claim 11, wherein the bottom of the draining pipe is blocked in and sealed between the upper and lower gasket-washer discs with the help of the upper and lower nuts.

13. The method according to claim 9, wherein the ceiling draining pipe defines at least one opening, the at least one opening sealed with a removable plate.

14. The method of claim 13, further comprising the step of removing the removable plate from the at least one opening.

15. The method of claim 14, further comprising the step of inspecting the ceiling draining pipe through the at least one opening.

* * * * *